US005960678A

United States Patent [19]

Kennedy

[11] Patent Number: 5,960,678

[45] Date of Patent: Oct. 5, 1999

[54] AUTOMATIC STRESS PLATE FEEDER

[76] Inventor: Harley K. Kennedy, 6 Sanderson Rd., Clendenin, W. Va. 25045

[21] Appl. No.: 09/054,413

[22] Filed: Apr. 3, 1998

Related U.S. Application Data

[60] Provisional application No. 60/045,077, Apr. 29, 1997.

[51] Int. Cl.[6] ..... B25B 23/06

[52] U.S. Cl. ..... 81/57.37; 221/212; 221/239; 81/57.41; 29/813

[58] Field of Search ..... 81/57.37, 433, 81/435, 57.41; 227/39, 43, 41, 99–100, 113–114, 135; 221/210, 212, 226, 239, 312 A; 29/813

[56] References Cited

U.S. PATENT DOCUMENTS

| | | |
|---|---|---|
| 3,017,794 | 1/1962 | Pouget . |
| 4,432,257 | 2/1984 | Yamamoto et al. . |
| 4,510,826 | 4/1985 | Marks . |
| 4,998,662 | 3/1991 | Hasan et al. . |
| 5,058,464 | 10/1991 | McGovern et al. . |
| 5,347,707 | 9/1994 | Beach . |

FOREIGN PATENT DOCUMENTS

| | | |
|---|---|---|
| 856896 | 8/1981 | U.S.S.R. . |

*Primary Examiner*—D. S. Meislin
*Attorney, Agent, or Firm*—Richard C. Litman

[57] ABSTRACT

An automatic stress plate feeder includes a generally horizontal stress plate magazine holding a series of generally flat stress plates each positioned generally vertically on edge therein. An electric motor drives the stress plates through the magazine, to drop them singly at a pickup point where they are picked up by a pair of magnetic arms and positioned generally horizontally beneath a screw gun extension. The screw gun extension includes a compression spring therein, causing it to telescope upwardly to provide clearance for each stress plate to be positioned beneath the screw gun extension and its bit. A screw feeder tube provides for the introduction of a screw into the screw gun extension, and the screw gun is compressed downwardly and operated to drive the screw through the plate positioned thereunder. The securing of the plate to the underlying structure causes the pickup arms to release the plate, whereupon they swing upwardly to pick up another plate to continue the process. The present machine enables a single roofer to distribute the plates and also to secure the plates in position as desired, without need for an additional worker to distribute the plates in a separate operation from the step of securing the plates.

19 Claims, 5 Drawing Sheets

AUTOMATIC STRESS PLATE FEEDER

REFERENCE TO RELATED PATENT APPLICATION

This application claims the benefit of U.S. Provisional Patent Application Ser. No. 60/045,077, filed on Apr. 29, 1997.

BACKGROUND OF THE INVENTION

1. Field of the Invention

The present invention relates generally to automated devices for dispensing single articles from a stacked or grouped array of like articles, and more specifically to a machine which enables a single roofing worker to place and attach stress plates automatically on a roofing structure, to secure insulation and the like. The device automatically picks up a single stress plate from a collection of such plates within the machine, and places it beneath a screw gun extension, whereupon the worker may secure the stress plate with a screw gun attached to the device. When the first plate is secured, the machine automatically picks up the next plate within the machine to repeat the process. Thus, the present machine eliminates need for another worker to locate the plates for the person driving the screw gun.

2. Description of the Related Art

The roofing industry is a labor intensive field, with work often occurring under adverse conditions of hot weather, with hot tar, heavy materials, etc. resulting in considerable strain on roofing workers. Also, considerable "stoop labor" is often involved in the attachment of roofing materials (sheathing, stress plates, insulation, etc.) to a roof structure.

Accordingly, some advances have been made in the field of automated equipment to ease the strain placed upon roofing workers. One such advance was the screw gun extension, described in an earlier issued patent and discussed further below. The device enabled a worker to stand, rather than kneeling or stooping, to position screws and drive the screws to secure roofing materials. However, the materials themselves still required placement by hand, directly upon the roof surface. Subsequently, various automated devices for placing stress plates upon a roof were developed, but each of these machines lacks some critical function provided by the present machine, and/or operates in some different way, than the present machine. A discussion of the related art known to the present inventor, and its differences and distinctions from the present invention, is provided below.

U.S. Pat. No. 3,017,794 issued on Jan. 23, 1962 to Edmond Pouget, titled "Apparatus For Setting Sleeper Screws Or Track Bolts To A Predetermined Degree Of Thickness," describes a device for use in laying or repairing railroad track. The device includes a screw or bolt driving extension, but as the device is intended to secure railroad track to ties or sleepers which are already in place, Pouget does not provide for the automatic laying or placement of any plates or the like, as provided by the present machine. The Pouget device is quite limited in its abilities, as it only provides for the tightening of screws or bolts to a predetermined setting, as limited by feelers and switches in the device. No means is provided for feeding screws through the machine, and driving those screws into plates also fed by the machine, both of which functions are provided by the present invention.

U.S. Pat. No. 4,432,257 issued on Feb. 21, 1984 to Kazuyoshi Yamamoto et al., titled "Shoe Bolt Securing And Removing Apparatus," describes a device for installing and removing bolts securing the shoes or cleats to the underlying track assembly for a tracked vehicle. The device includes means for positioning the bolt driving apparatus precisely over the bolt to be driven or removed, but does not include any means of feeding any article to be secured by the bolt (i. e., the track shoes, cleats, or plates). The present invention includes a generally horizontal magazine adapted to contain a plurality of horizontally stacked stress plates, with the present machine feeding the plates singly to be disposed beneath a screw gun extension comprising a part of the machine.

U.S. Pat. No. 4,510,826 issued on Apr. 16, 1985 to Milton Marks, titled "Extension For A Screwgun," describes a device comprising an elongate telescoping tube having a spring loaded, normally retracted screw gun extension disposed therein. A screw feeder tube extends from the telescoping tube at a shallow angle. Screws are fed singly through the feeder tube, and drop into the lower part of the telescoping tube through a slot therein. The screw gun is then pressed downwardly, to cause the telescoping tube to collapse and lower the extension bit onto the screw, to drive the screw. No additional means is disclosed by Marks for feeding stress plates beneath the lower end of the screw gun extension tube, as provided by the present invention. While the present invention makes use of a screw gun extension similar to the Marks device, it also includes numerous features which extend well beyond the Marks device.

U.S. Pat. No. 4,998,662 issued on Mar. 12, 1991 to Syed R. Hasan et al., titled "Fastener-Driving And Batten-Positioning Machine," describes an apparatus comprising a wheeled base with a screw gun attachment and a generally circular device for the continuous feeding of a continuous length of batten strip. No magazine is disclosed to provide for the single feeding of separate stress plates, as provided by the present invention, nor is any means provided for the separate distribution of single articles, such as stress plates, as provided by the present machine.

U.S. Pat. No. 5,058,464 issued on Oct. 22, 1991 to Hubert T. McGovern et al., titled "Roof Fastener Installation Machine," describes a machine which feeds plates singly from a vertically disposed magazine to a transfer mechanism which places the plates one at a time below a screw gun extension, similar to the Marks device discussed further above. The device operates pneumatically rather than like the present electrically powered invention, and requires an on board source of compressed air, unlike the present machine. A relatively complex pneumatic timing device is required to coordinate the feeding of each plate beneath the screw gun extension, which mechanism is not required with the present machine. The horizontal magazine of the present stress plate feeder overcomes certain problems inherent in vertically disposed magazines, such as the McGovern machine, due to the weight of the plates stacked in a relatively full magazine bearing upon the bottommost plate within the magazine and the resulting difficulty in extracting that plate for use.

U.S. Pat. No. 5,347,707 issued on Sep. 20, 1994 to John R. Beach, titled "Roofing Washer-Dispensing And Fastener-Driving Machine," describes a machine including a generally vertical magazine and single washer or plate dispensing means, and a screw gun, extension, and screw feeder. The device is thus quite similar to that described in the McGovern et al. patent discussed above. The device is purely mechanical, with the exception of the electrically powered screw gun, and washers or plates are advanced singly and horizontally from the bottom of the magazine by a horizontal slider mechanism. They are captured beneath the screw gun by a spring loaded latch mechanism, to position them for securing with the screw gun. The present machine utilizes a horizontally disposed magazine, with plates being disposed with their planar surfaces generally vertical therein and advanced singly by an electric motor controlled by a microswitch, unlike the Beach machine.

Finally, Soviet Patent Publication No. 856,896 published on Aug. 25, 1981 illustrates a nail or fastener feeding device which transfers fasteners from one storage area to another. No means is shown for securing the fasteners to another article, nor are any other articles (e. g., stress plates or washers, etc.), or means of distributing or placing them, shown in the drawing figures of the '896 Soviet publication.

None of the above inventions and patents, taken either singly or in combination, is seen to describe the instant invention as claimed.

SUMMARY OF THE INVENTION

The present invention comprises an automatic stress plate feeder machine, for singly dispensing and fastening stress plates or the like on a roof structure to secure insulation or other roofing materials in place. The machine includes a generally horizontally disposed stress plate magazine, with the generally planar stress plates being carried vertically on edge therein. A motor advances the plates to cause them to drop singly into a pickup area, where they are picked up by a pair of magnetic arms and swung beneath a screw gun extension. The screw gun is then pressed downwardly, to drive a screw into the center of the plate to secure the plate at the desired location. The device is operable by a single roofer, rather than requiring one person to distribute the plates and another to secure the plates in place.

Accordingly, it is a principal object of the invention to provide an improved automatic stress plate feeder which both singly distributes stress plates on a surface, and which also positions each of the plates for fastening and which provides for fastening each of the plates in place separately.

It is another object of the invention to provide an improved stress plate feeder which includes a horizontally disposed stress plate magazine or carrier, and electric motor and control means for advancing the stress plates singly from the magazine to a pickup area.

It is a further object of the invention to provide an improved stress plate feeder which includes means for repositioning each plate from a generally vertical or on edge orientation, to a generally horizontal orientation beneath a screw gun extension.

An additional object of the invention is to provide an improved stress plate feeder which includes a screw gun and screw gun extension for securing the stress plates singly to an underlying structure.

Still another object of the invention is to provide an improved stress plate feeder which stress plate magazine is easily removable and reloadable for efficient operation of the device.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
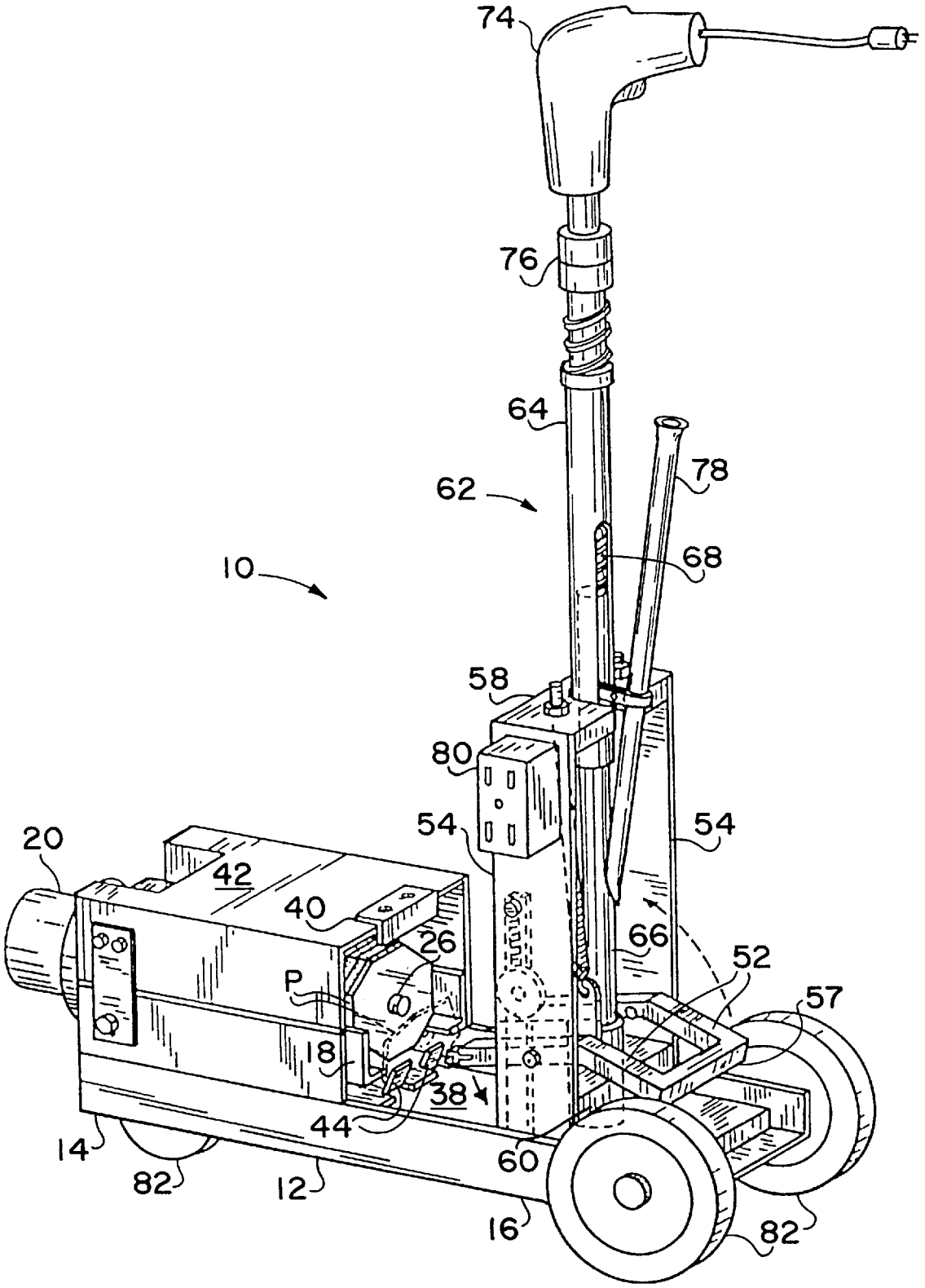
FIG. 1 is a perspective view of the present automatic stress plate feeder and screw gun extension installed therewith, showing its general features.
Figure 4:
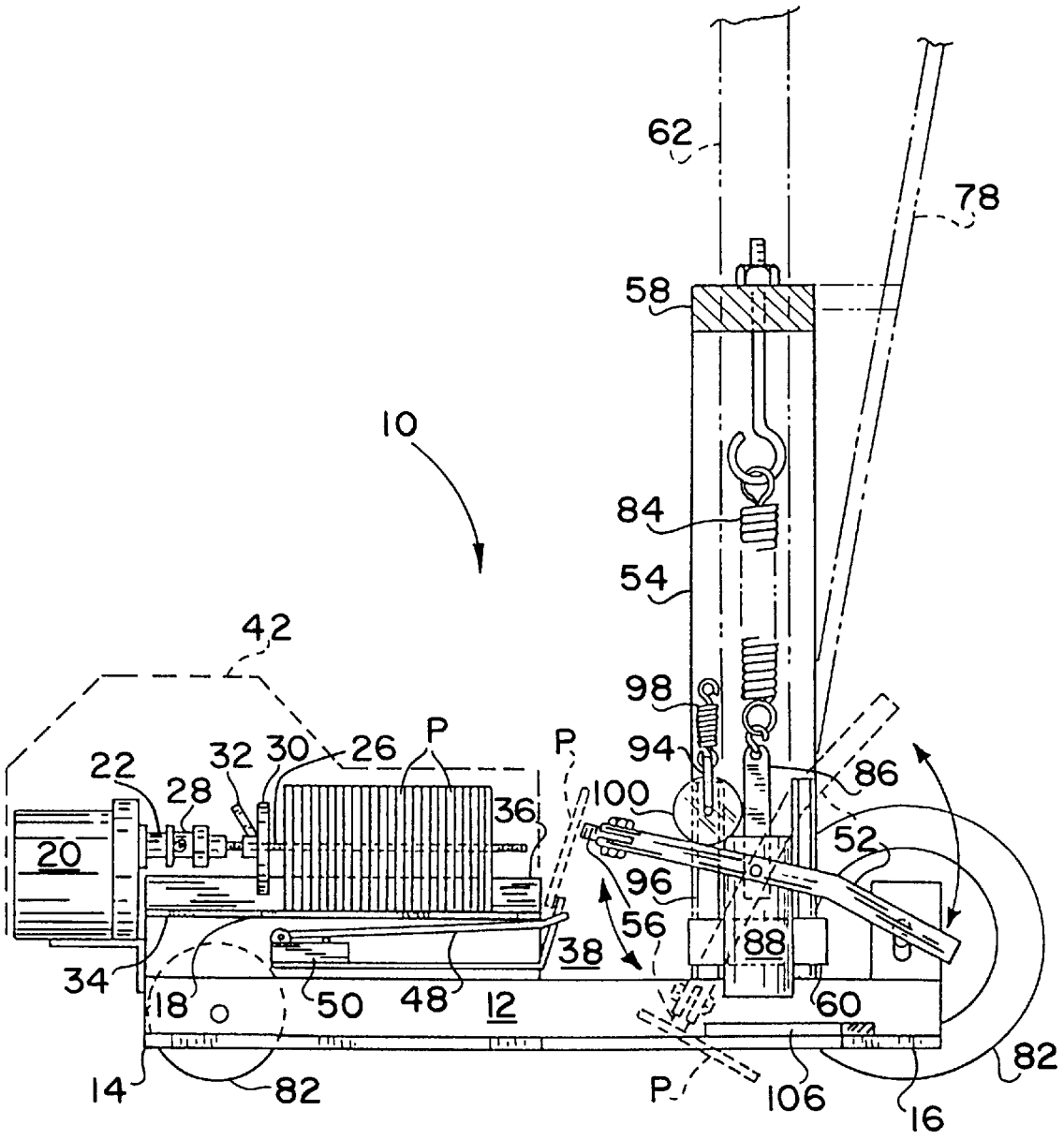
FIG. 4 is a side elevation view in section of the present stress plate feeder, showing the operation of the device.

The present invention comprises an automatic stress plate feeder, indicated by the reference numeral 10 in FIGS. 1 and 4. The present stress plate feeder 10 is a semi-automated device for use in the roofing industry, for distributing stress plates or washers over a roof and then securing the plates to the underlying structure, to secure insulation or the like in place in the roof structure.

The stress plate feeder 10 includes an elongate frame 12 comprising a generally U-shaped channel of rectangular form, and having a first or stress plate magazine end 14 and an opposite second or stress plate distribution end 16. The first end 14 of the frame 12 includes a generally horizontally disposed, elongate stress plate magazine 18 aligned within or along the frame 12, for holding a plurality of stress plates P therein and also providing for advancing the plates P for single distribution as desired.

Figure 3:
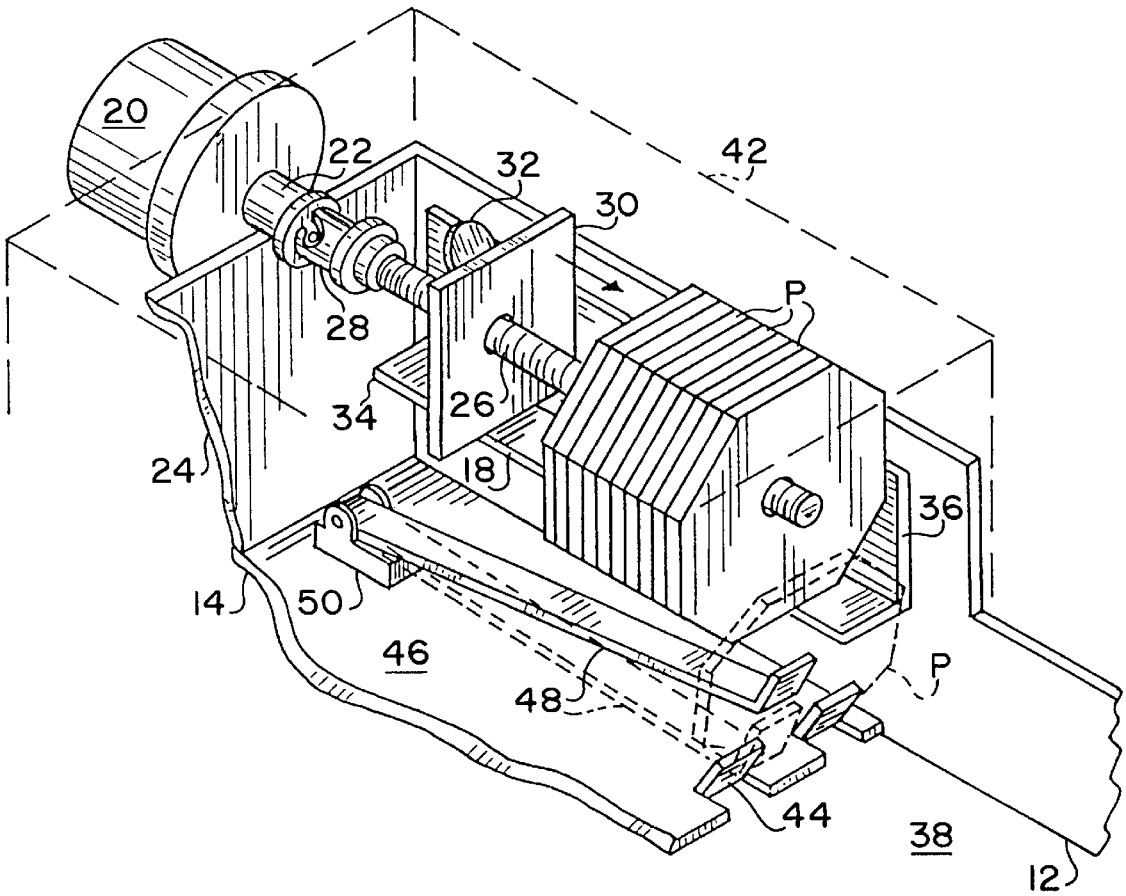
FIG. 3 is a broken away perspective view of the stress plate feeder magazine and means for feeding the stress plates singly to a pickup area.

FIG. 3 provides a more detailed view of the stress plate feeder magazine 18 and the first end 14 of the frame 12. The magazine 18 is formed of a pair of facing channels which act as guides for the stress plates P stacked therein. The plates P may be round, rectangular, or may have some polygonal shape as shown, and are stamped or otherwise formed of a planar sheet of material. As each of the plates P to be used at any one time are congruent to one another, they may be stacked on edge (i. e., with one of their major dimensions aligned generally vertically, or normal to the elongate axis of the magazine), as shown in FIGS. 1, 3, and 4.

A stress plate feed electric drive motor 20 with appropriate speed reduction means is installed at the first end 14 of the frame 12, with an output or drive shaft 22 extending through the first end cover 24 of the frame 12. The motor shaft 22 is connected to a threaded stress plate advance rod or screw 26 by a quick disconnect coupling (e. g., bayonet coupling) 28. The stress plates P are each conventionally provided with a central hole or passage, through which the advance rod 26 extends. However, the plate holes are somewhat larger than the diameter of the advance rod 26, and do not engage the threads of the advance rod. An advance or push plate 30 is threadedly engaged with the advance rod 26, and is kept from turning on the rod 26 by also engaging the inner corners of the magazine 18 channels. A quick release tab 32 is provided on the push plate 30, to quickly release it from the threads of the advance rod 26, for loading the magazine 18.

Thus, as the motor 20 is operated, the advance screw 26 is turned to cause the push plate 30 to advance along the rod 26 from the first end 34 toward the second end 36 of the magazine 18. Any stress plates P along the rod 26 and in front of the push plate 30, are pushed along the rod 26 and through the magazine 18 toward its second end 36. As the stress plates P are advanced along the rod 26 due to the action of the push plate 30 as it threadedly advances along the rod 26 as the motor 20 operates, the first of the plates P along the shaft or rod 26 (i. e., the plate closest to the end of the rod 26, and farthest from the push plate 30) will be pushed from the end of the rod 26 to fall into a stress plate transfer area 38. A lip 40 (FIG. 1) is provided on the magazine cover 42 to guide the stress plate P properly.

The stress plate transfer area 38 includes a pair of spaced apart catches 44 formed in the floor 46 of the frame 12 (as shown in FIG. 3) or otherwise located within the frame 12. A trigger or extension 48 extends between the two stress plate catches 44, and is depressed when a single plate P falls from the end of the advance rod 26 and is caught by the catches 44 and held generally on edge thereby, and slightly tilted toward the second end 16 of the frame 12. The extension 48 serves to deactivate the motor 20 by means of a microswitch 50 disposed within the first end 14 of the frame 12, thus precluding further advance of the plates P along the rod 26 when a single plate P drops from the end of the rod 26 to trip the switch extension 48, and open the switch 50.

A pair of interconnected pivotally mounted stress plate pickup arms 52 (FIGS. 1 and 4) are secured between a pair of spaced apart uprights 54, which extend upwardly from the second end 16 of the frame 12. These arms 52 each have a magnet 56 installed at their distal ends, for temporarily picking up a metal stress plate P magnetically. The interconnection 57 between the two arms 52 also serves as a counterbalance, to keep the two arms 52 in a normally raised position with the magnets 56 disposed toward the plates P as they pass from the end of the advance rod 26, to the transfer area 38.

As a plate P falls from the end of the rod 26, it falls against the two magnets 56 at the ends of the two raised pickup arms 52. While the weight of the plate P may be sufficient to cause the arms 52 to pivot downwardly through the open bottom of the frame 12 in the plate transfer area 38, additional means (described further below) is provided to assist the action. The pivoting action of the arms 52 also turns the plate P magnetically secured thereto, from a substantially on-edge, vertical orientation to a substantially horizontal orientation beneath the second end 16 of the frame 12 and between the two uprights 54, as shown in FIG. 4. In other words, the plane of the plate P is always tangent to the arc described by the two magnets 56 as they swivel between a raised, plate pickup point (shown in solid lines in FIG. 4), downwardly toward a lowered, plate deposit point (shown in broken lines in FIG. 4). (It will be understood that in FIG. 4 the arms 52 and plate P magnetically secured thereto are shown with their travel only partially completed to the above described lowest position.)

The structure described to this point serves to pick up a stress plate P from the magazine 18, and position the plate P in a horizontal orientation generally parallel to the underlying structure for securing thereto. The second end 16 of the frame 12 of the present automatic stress plate feeder machine 10, with its uprights 54, serves to hold screw driving means for selectively driving a screw through the center hole of each plate P as it is positioned beneath the second end 16 of the frame 12. The two uprights 54 include an upper receiver block 58 and a lower receiver block 60 affixed therebetween, serving to hold a screw gun extension assembly 62 generally vertically therein.

The screw gun extension 62 is generally similar to that described in U.S. Pat. No. 4,510,826 and discussed further above in the Description of the Related Art, and is shown in combination with the balance of the structure in FIGS. 1 and 2. Essentially, the extension 62 comprises a relatively large diameter upper tube 64, which telescopes over a smaller diameter lower tube 66 and is urged to an extended position by a coil spring 68 within the assembly. An extension shaft 70, with a screw driving bit 72 depending from its lower end, is installed concentrically within the tubes 64 and 66 and is held above the underlying surface by the spring 68 and other means described further below. An electric screw gun 74 is secured to the upper end of the upper tube 64 by a coupling 76, and is selectively operated by a roofer to drive a screw through a plate P disposed therebelow, as desired. The screw gun extension 62 may also be equipped with a screw feeder tube 78, for feeding screws singly into the lower tube 66 for driving with the bit 72.

Figure 5:
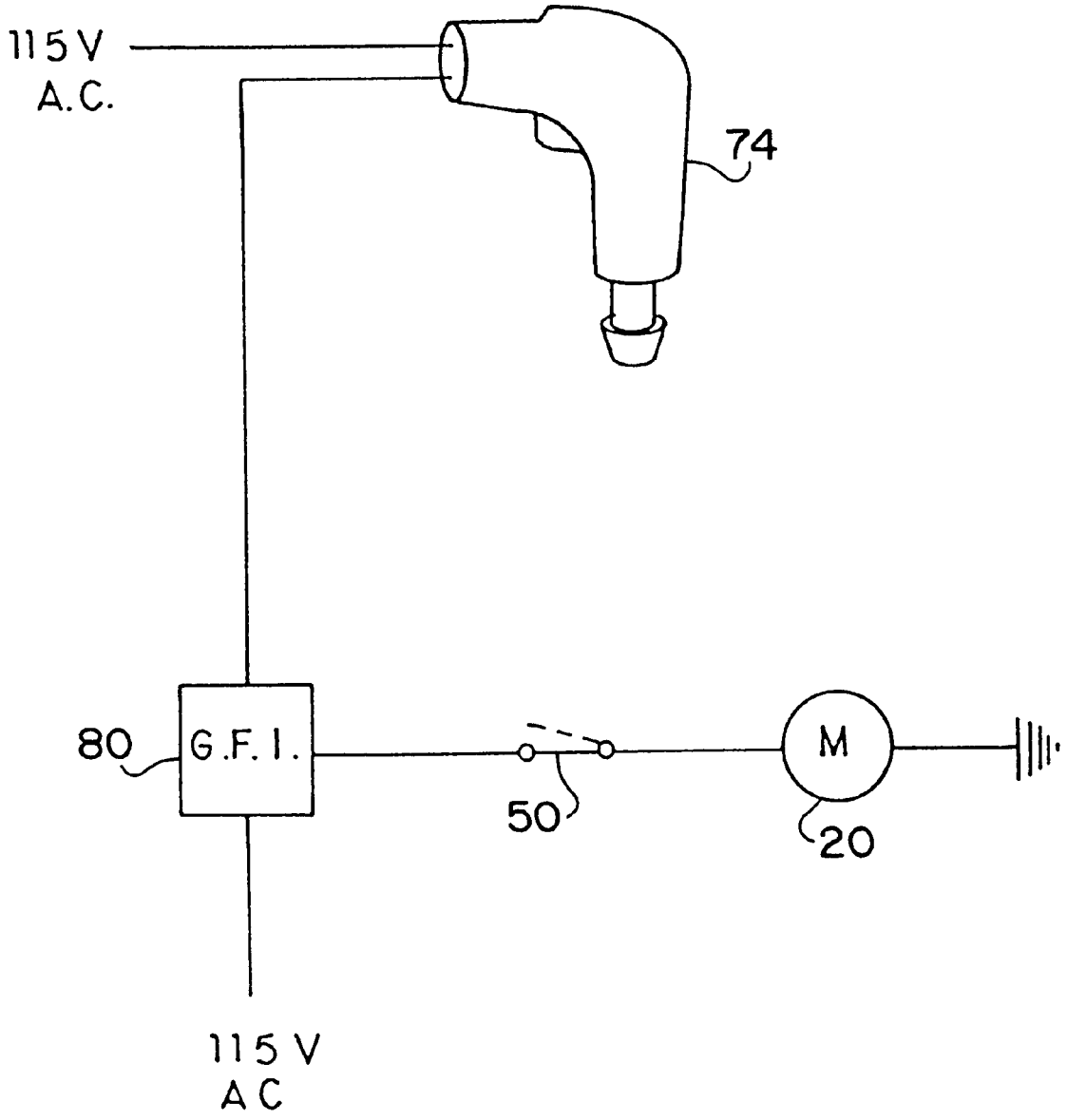
FIG. 5 is an electrical schematic of the present stress plate feeder machine.

The present automatic stress plate feeder machine 10 is readied for use by filling the magazine 18 with stress plates P as desired. The quick disconnect coupling 28 and quickly repositionable advance or push plate 30 allow the magazine 18 to be replenished in only a few seconds. The machine 10 is then operated by connecting the device to a suitable source of electrical power (115 volts ac), by means of an appropriate extension cord, using an outlet receptacle box such as the attached ground fault interrupter receptacle 80 shown in FIG. 1. The GFI box 80 may be used to supply electrical power to the stress plate feed drive motor 20 through the switch 50 and also to the screw gun 74, if it is plugged into the outlet 80. The screw gun 74 may alternatively be plugged into another source of electrical current, if desired, as indicated by the "115V A.C." line extending from the screw gun 74 in FIG. 5.

Figure 2:
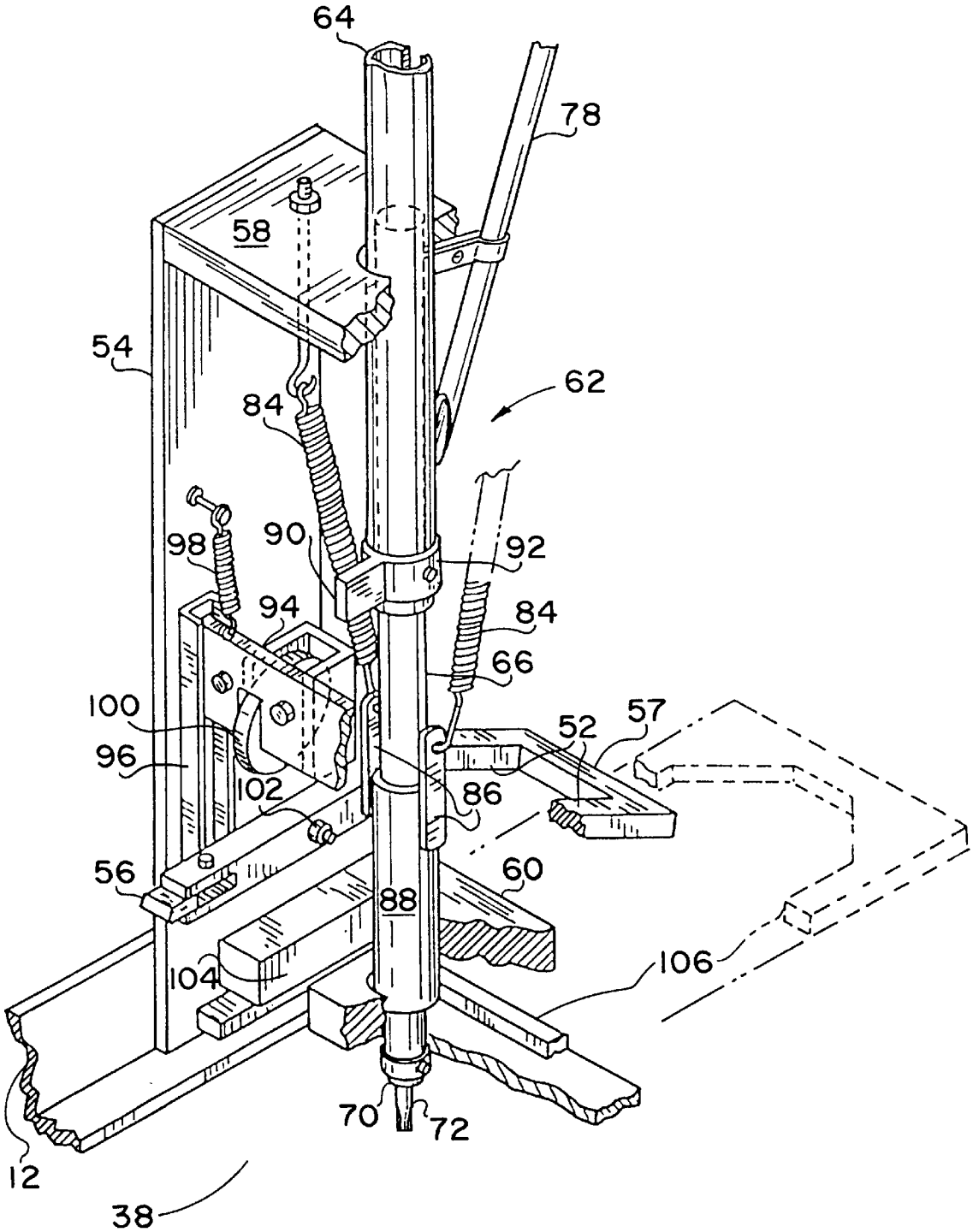
FIG. 2 is a broken away perspective view of the screw gun extension tube and mechanism for positioning the plates beneath the screw gun extension.

The machine 10 is then positioned on the roof structure as desired, and rolled along the desired line of application of the stress plates P by means of the wheels 82 extending from the frame 12 of the machine 10. When the desired point of application of a stress plate P is reached, the generally vertically oriented screw feeder extension 62 is positioned thereover, and the screw gun 74 is pushed downwardly. The screw gun extension 62 is held in a normally raised position by a pair of springs 84 extending downwardly from the upper receiver block 58 and attached to a corresponding pair of lugs 86 extending from a collar 88 about the lower tube 66, as shown in FIGS. 2 and 4.

This causes an arm 90, which extends from a second collar 92 affixed to the lower end of the upper tube 64, to move downwardly with the screw gun extension 62. As this arm 90 moves downwardly, it contacts a guide wheel carrier 94, which extends between the two uprights 54 and travels in channels 96 affixed to the inner walls of the two uprights 54. The carrier 94 is held in a normally raised position by springs 98 extending from each inner wall of uprights 54, and connected to each end of the carrier 94. The carrier 94 includes a pair of spaced apart pivot arm contact guide wheels 100, which are driven downwardly to contact the extended ends of the plate pickup arms 52 between their pivot points 102 and magnets 56.

Thus, as the screw gun extension 62 is pushed downwardly, the guide wheel carrier 94 is also moved downwardly to cause the plate pickup arms 52 to pivot downwardly by means of the guide wheels 100. (Slots 104 are provided in the lower receiver block 60 to clear the arms 52.) A stress plate P temporarily magnetically carried on the pickup arms 52, is thus swiveled downwardly to be suspended from the two arms 52 immediately beneath the screw gun extension 62 and its screw driving bit 72. Additional downward movement of the screw gun extension 62 pushes the screw driving bit 72 and screw disposed thereon (not shown) into the center hole of the plate P, and pushes the plate P from the magnets 56 of the pickup arms 52, causing the plate P to drop downwardly onto the underlying surface. The screw gun 74 is activated at this point to drive the screw through the hole in the plate P, thereby securing the plate P to the underlying structure.

After the plate P has been secured to the underlying surface, downward pressure on the screw gun extension 62 is released, allowing the extension 62 to rise. This also allows the guide wheel carrier 94 to rise, thus allowing the distal ends of the pickup arms 52 with their magnets 56 to rise, particularly now that they are free of the weight of the stress plate P magnetically suspended therefrom. The arms 52 and their magnets 56 swivel upwardly into the plate pickup area 38, whereupon they contact the next plate P which has been advanced to this area by the motor 20, after the first plate P was picked up to release the weight on the motor cutoff switch 50. The machine 10 is advanced to the next spot where a stress plate P is to be installed, and the screw gun extension 62 lowered to repeat the process described above.

In summary, the present automated stress plate feeder machine will be seen to provide for a considerable reduction of labor in the roofing field, particularly in the application of stress plates to a roof structure for securing insulation thereon. Only a single worker is required to operate the present machine, and operation is absolute simplicity, thanks to the novel mechanism used. Stoop labor on a roof is completely eliminated during the actual installation of stress plates using the present machine, with the only operations requiring anything other than a standing position, being the loading of the stress plate feeder magazine from time to time to replenish the machine.

While octagonal stress plates are shown in the drawing figures illustrating the structure and operation of the present machine, it should be noted that the machine is capable of accepting virtually any shape and configuration of stress plate, by means of various adapters (such as the adapter 106 shown in FIG. 2) which may be removably installed within the second end of the machine frame. Such adapters serve as guides to assure that the stress plates delivered beneath the screw gun extension, are properly positioned for receiving a screw and for securing to the underlying structure. Thus, the versatility and ease of use of the present machine will result in considerable savings in time and effort in the installation of stress plates in a roofing structure.

It is to be understood that the present invention is not limited to the embodiments described above, but encompasses any and all embodiments within the scope of the following claims.

I claim:

1. An automatic stress plate feeder, comprising:

an elongate frame having a first end and an opposite second end;

a generally horizontally disposed, elongate stress plate feeder magazine for holding a plurality of individual stress plates on edge therein, said magazine having a first end and an opposite second end and being positioned within said first end of said frame and aligned with said frame;

a stress plate transfer area disposed within said frame and adjacent said second end of said magazine, for holding a single one of the stress plates generally on edge;

drive means for advancing the stress plates within said magazine, from said first end of said magazine and past said second end of said magazine to said stress plate transfer area;

switch means for detecting when one of the stress plates is positioned within said stress plate transfer area, and for controlling said drive means accordingly; and pivoting stress plate pickup means for repeatedly picking up a single one of the stress plates from said stress plate transfer area, and pivotally swinging the single stress plate downwardly to position the stress plate generally horizontally for securing to an underlying structure.

2. The automatic stress plate feeder according to claim 1, including screw driving means for driving a screw through one of the stress plates, extending from said second end of said frame.

3. The automatic stress plate feeder according to claim 2, wherein said screw driving means comprises a telescoping tube normally raised within said second end of said frame and having a screw driving extension therethrough with a screw driving tip depending therefrom and an electric screw gun disposed thereatop, with said screw driving means being selectively lowerable to apply said screw driving tip to a screw through the stress plate disposed therebeneath.

4. The automatic stress plate feeder according to claim 2, including interface means between said screw driving means and said pivoting stress plate pickup means, comprising at least one pivot arm contact guide wheel extending from said telescoping tube of said screw driving means for driving said pivoting stress plate pickup means arcuately downwardly for positioning the stress plate held thereby generally horizontally beneath said screw driving means when said screw driving means is selectively lowered.

5. The automatic stress plate feeder according to claim 2, including a screw feeder tube communicating with said telescoping tube of said screw driving means, for feeding single screws to said screw driving means.

6. The automatic stress plate feeder according to claim 2, wherein said pivoting stress plate pickup means includes at least one arm having a distal end with a magnet secured thereto, for momentarily holding the single stress plate during transfer of the stress plate from said stress plate transfer area to a point beneath said screw driving means.

7. The automatic stress plate feeder according to claim 2, with the stress plates having a specific peripheral configuration, including an interchangeable adapter guide corresponding to the specific peripheral configuration of the stress plates for holding the single stress plate accurately beneath said screw driving means.

8. The automatic stress plate feeder according to claim 1, including electrical power means for said drive means for advancing the stress plates within said magazine and for said screw driving means.

9. The automatic stress plate feeder according to claim 1, including quick release means for said magazine, and means for quickly refilling said magazine.

10. The automatic stress plate feeder according to claim 1, including wheel means for supporting said frame.

11. An automatic stress plate feeder, comprising:

an elongate frame having a first end and an opposite second end;

a generally horizontally disposed, elongate stress plate feeder magazine for holding a plurality of individual stress plates on edge therein, said magazine having a first end and an opposite second end, positioned within said first end of said frame and aligned with said frame;

a stress plate transfer area disposed within said frame and adjacent said second end of said magazine, for holding one of the stress plates generally on edge;

drive means for advancing the stress plates within said magazine, from said first end of said magazine and past said second end of said magazine to said stress plate transfer area;

switch means for detecting when a single one of the stress plates is positioned within said stress plate transfer area, and for controlling said drive means accordingly;

screw driving means for driving a screw through one of the stress plates, extending from said second end of said frame; and pivoting stress plate pickup means for repeatedly picking up the single stress plate from said stress plate transfer area, and pivotally swinging the single stress plate downwardly to position the stress plate horizontally beneath said screw driving means for securing the stress plate to an underlying structure.

12. The automatic stress plate feeder according to claim 11, wherein said screw driving means comprises a telescoping tube normally raised within said second end of said frame and having a screw driving extension therethrough with a screw driving tip depending therefrom and an electric screw gun disposed thereatop, with said screw driving means being selectively lowerable to apply said screw driving tip to a screw through the stress plate disposed therebeneath.

13. The automatic stress plate feeder according to claim 11, including interface means between said screw driving means and said pivoting stress plate pickup means, comprising at least one pivot arm contact guide wheel extending from said telescoping tube of said screw driving means for driving said pivoting stress plate pickup means arcuately downwardly for positioning the stress plate held thereby generally horizontally beneath said screw driving means when said screw driving means is selectively lowered.

14. The automatic stress plate feeder according to claim 11, including a screw feeder tube communicating with said telescoping tube of said screw driving means, for feeding single screws to said screw driving means.

15. The automatic stress plate feeder according to claim 11, wherein said pivoting stress plate pickup means includes at least one arm having a distal end with a magnet secured thereto, for momentarily holding the single stress plate during transfer of the stress plate from said stress plate transfer area to a point beneath said screw driving means.

16. The automatic stress plate feeder according to claim 11, with the stress plates having a specific peripheral configuration, including an interchangeable adapter guide corresponding to the specific peripheral configuration of the stress plates for holding the single stress plate accurately beneath said screw driving means.

17. The automatic stress plate feeder according to claim 11, including electrical power means for said drive means for advancing the stress plates within said magazine and for said screw driving means.

18. The automatic stress plate feeder according to claim 11, including quick release means for said magazine, and means for quickly refilling said magazine.

19. The automatic stress plate feeder according to claim 11, including wheel means for supporting said frame.

* * * * *